US008700391B1

(12) United States Patent
Avendano et al.

(10) Patent No.: US 8,700,391 B1
(45) Date of Patent: Apr. 15, 2014

(54) LOW COMPLEXITY BANDWIDTH EXPANSION OF SPEECH

(75) Inventors: Carlos Avendano, Campbell, CA (US); Carlo Murgia, Sunnyvale, CA (US); Dana Massie, Santa Cruz, CA (US)

(73) Assignee: Audience, Inc., Mountain View, CA (US)

( * ) Notice: Subject to any disclaimer, the term of this patent is extended or adjusted under 35 U.S.C. 154(b) by 619 days.

(21) Appl. No.: 12/895,254

(22) Filed: Sep. 30, 2010

Related U.S. Application Data

(60) Provisional application No. 61/319,881, filed on Apr. 1, 2010.

(51) Int. Cl.
*G10L 21/02* (2013.01)

(52) U.S. Cl.
USPC ..... 704/220

(58) Field of Classification Search
USPC ..... 704/200–230, 500–504
See application file for complete search history.

(56) References Cited

U.S. PATENT DOCUMENTS

| | | | | |
|---|---|---|---|---|
| 3,517,223 | A * | 6/1970 | Gaunt, Jr. | 327/232 |
| 6,377,915 | B1 * | 4/2002 | Sasaki | 704/206 |
| 6,895,375 | B2 * | 5/2005 | Malah et al. | 704/219 |
| 8,078,474 | B2 * | 12/2011 | Vos et al. | 704/500 |
| 8,271,292 | B2 * | 9/2012 | Osada et al. | 704/500 |
| 2003/0093278 | A1 * | 5/2003 | Malah | 704/265 |
| 2007/0299655 | A1 * | 12/2007 | Laaksonen et al. | 704/205 |

* cited by examiner

*Primary Examiner* — Abul Azad
(74) *Attorney, Agent, or Firm* — Carr & Ferrell LLP

(57) ABSTRACT

Audio signal bandwidth expansion is performed on a narrow bandwidth signal received from a far end source. The far end source may transmit the signal over the audio communication network. The narrow band signal bandwidth is expanded such that the bandwidth exceeds that of the audio communication network. The signal may be expanded by performing frequency folding on the signal. One or more features are determined for the narrow bandwidth signal, and the expanded signal is modified based on a feature. The feature may be signal band energy slope, narrow band signal energy, or some other feature. The modification may be performed by a shelf filter selected based on the feature. The modified signals are provided for additional processing. In some embodiments, a noise component is added to the narrow band signal prior to folding to create an excitation that reduces the appearance of a fully harmonic signal characteristic.

17 Claims, 9 Drawing Sheets

LOW COMPLEXITY BANDWIDTH EXPANSION OF SPEECH

CROSS REFERENCE TO RELATED APPLICATIONS

This application claims the benefit of U.S. Provisional Application No. 61/319,881, filed on Apr. 1, 2010, entitled "Low Complexity Bandwidth Expansion of Speech," the disclosure of which is incorporated herein by reference.

BACKGROUND

1. Field of the Invention

The present invention relates generally to audio processing, and more particularly to audio signal analysis.

2. Description of Related Art

Audio communication networks often have bandwidth limitations that affect the quality of the audio transmitted over the network. For example, telephone channel networks limit the bandwidth received by the receiver to 300 Hz to 3500 Hz. As a result, speech transmitted using only this limited bandwidth sounds thin and dull due to the lack of low and high frequency content in the audio signal.

Previous systems approached the issue in different ways. Some systems attempt to improve audio quality in a narrow bandwidth system by dividing the received signal into an envelope and an excitation portion. The system then analyzed and attempted to extend the bandwidth of both the envelope and excitation signals independently. This system requires a lot of resources and introduces latency in the processing.

Some previous systems attempt to remedy a narrow band audio signal by determining a mapping of the signal frequency components and reconstructing missing frequencies using an algorithm based on the mapped signal frequency components. This system also is not practical for use with audio applications due to introduced latency effects.

Therefore, there is a need for systems and methods to be able to quickly and efficiently improve the audio quality over bandwidth limited networks.

SUMMARY

The present technology may provide audio signal bandwidth expansion for a narrow bandwidth signal received from a far end source. The far end source may transmit the signal over the audio communication network. The narrow band signal bandwidth is then expanded such that the bandwidth is greater than that of the audio communication network. The signal may be expanded by performing frequency folding on the signal. One or more features are then determined for the narrow bandwidth signal, and the expanded signal is modified based on a feature. The feature may be signal band energy slope, narrow band signal energy, or some other feature. The modification may be performed by a shelf filter selected based on the feature. The modified signals are then provided for additional processing. In some embodiments, a noise component is added to the narrow band signal prior to folding to create an excitation that reduces the appearance of a fully harmonic signal characteristic. An embodiment may process an audio signal to expand the bandwidth of the signal. A feature may be determined for a received signal. A bandwidth expansion module stored in memory may be executed to expand the spectrum of the received signal to create an expanded signal. The expanded signal may be modified based on the feature of the received signal.

An embodiment may include a system that expands the bandwidth of an audio signal. The system may include a processor as well as a signal fold module and feature extraction module stored in memory and executable by the processor. The signal fold module may be executed to receive an audio signal and provide an expanded signal having an expanded spectrum. The feature extraction module may be executed to receive the audio signal and provide a feature based on the audio signal. The signal shaping may be executed to modify the expanded signal based on the feature.

A computer readable storage medium as described herein has embodied thereon a program executable by a processor to perform a method for expanding the bandwidth of an audio signal as described above.

Other aspects and advantages of the present invention can be seen on review of the drawings, the detailed description, and the claims which follow.

DETAILED DESCRIPTION

The present technology expands the bandwidth of an audio signal received over an audio communication network. The bandwidth expansion is simple and efficient, hence low complexity, such that it minimizes the resources and time required to expand signal bandwidth. This allows for additional processing to be performed in near real time on the expanded audio signal without any discernible delay on the output signal Audio signal bandwidth expansion may begin with receiving a narrow bandwidth signal from a far end source. The far end source may transmit the signal over the audio communication network. The narrow band signal bandwidth is then expanded such that the bandwidth is greater than that of the audio communication network. The signal may be expanded by performing frequency folding on the signal. One or more features are then determined for the narrow bandwidth signal, and the expanded signal is modified based on a feature. The feature may be signal band energy slope, narrow band signal energy, or some other feature. The modification may be performed by a shelf filter selected based on the feature. The modified signals are then provided for additional processing. In some embodiments, a noise component may be added to the narrow band signal to reduce the appearance of a non-harmonic signal characteristic.

Figure 1:
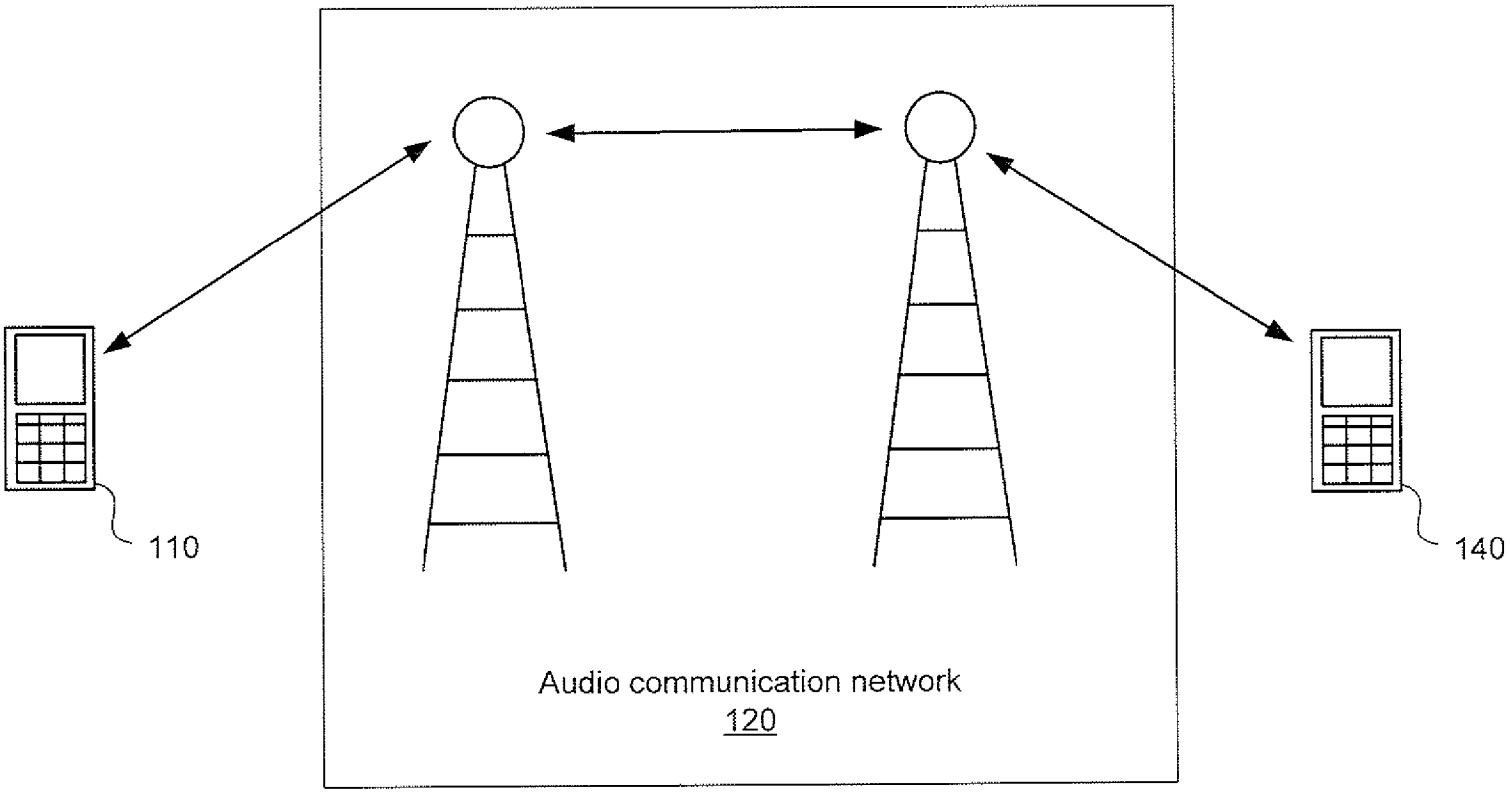
FIG. 1 is an exemplary system for communicating between audio devices.

FIG. 1 is an exemplary system for communication between audio devices. FIG. 1 includes mobile device 140, mobile device 110, and audio communication network 120. Audio communication network may communicate an audio signal between audio device 140 and audio device 110. The bandwidth of the audio signal sent between the audio devices maybe limited to between 300 HZ-3.500 Hz. Mobile devices 110 and 140, however, may output audio signals having a frequency outside the range allowed by the audio communication network, such as between 200 Hz and 8000 Hz.

Figure 2:
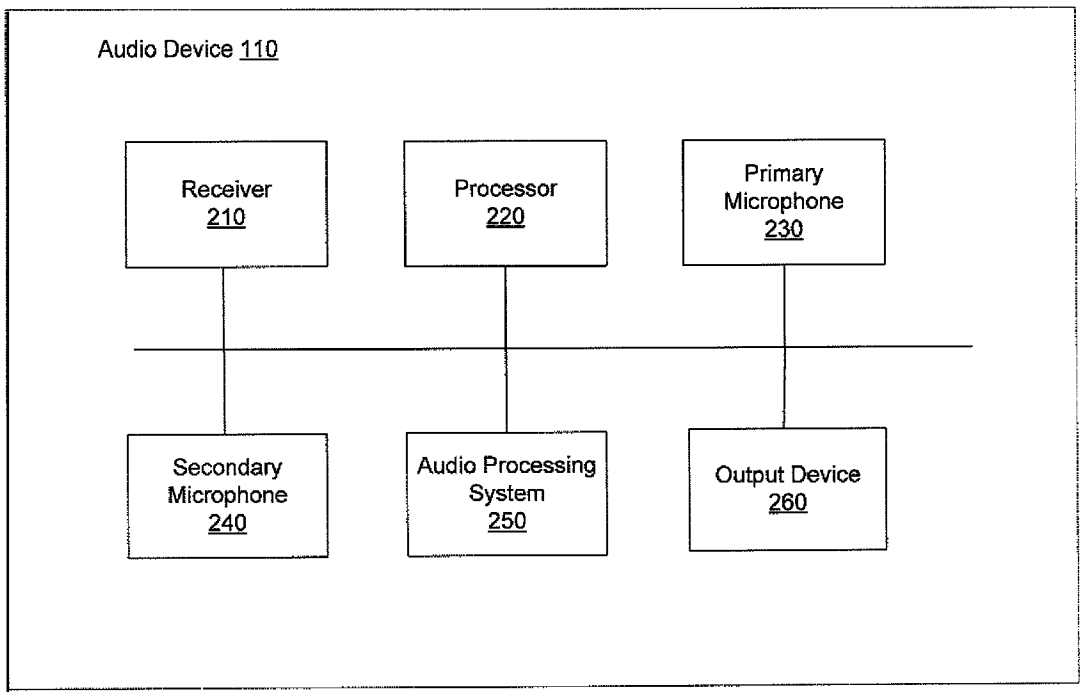
FIG. 2 is a block diagram of an exemplary audio device.

FIG. 2 is a block diagram of an exemplary audio device. In the illustrated embodiment, the audio device 110 includes a receiver 210, a processor 220, the primary microphone 230, an optional secondary microphone 240, an audio processing system 250, and an output device 260. The audio device 110 may include further or other components necessary for audio device 110 operations. Similarly, the audio device 110 may include fewer components that perform similar or equivalent functions to those depicted in FIG. 2.

Processor 220 may execute instructions and modules stored in a memory (not illustrated in FIG. 2) in the audio device 110 to perform functionality described herein, including bandwidth expansion for a received far-end signal. Processor 220 may include hardware and software implemented as a processing unit, which may process floating point operations and other operations for the processor 220.

The exemplary receiver 210 is an acoustic sensor configured to receive a signal from a communications network. In some embodiments, the receiver 210 may include an antenna device. The signal may then be forwarded to the audio processing system 250 to reduce noise using the techniques described herein, and provide an audio signal to the output device 260. The present technology may be used in one or both of the transmit and receive paths of the audio device 110.

The audio processing system 250 is configured to receive the acoustic signals from an acoustic source via the primary microphone 230 and secondary microphone 240 and process the acoustic signals. Processing may include generating sub-band signals from one or more received acoustic signals, performing noise reduction on the sub-band signals, and reconstructing the noise-reduced (i.e., modified) sub-band signals. The audio processing system 250 is discussed in more detail below.

The primary and secondary microphones 230 and 240 may be spaced a distance apart in order to allow for detection of an energy level difference between them. The acoustic signals received by primary microphone 230 and secondary microphone 240 may be converted into electrical signals (i.e. a primary electrical signal and a secondary electrical signal). The electrical signals may themselves be converted by an analog-to-digital converter (not shown) into digital signals for processing in accordance with some embodiments. In order to differentiate the acoustic signals for clarity purposes, the acoustic signal received by the primary microphone 230 is herein referred to as the primary acoustic signal, while the acoustic signal received from by the secondary microphone 240 is herein referred to as the secondary acoustic signal. The primary acoustic signal and the secondary acoustic signal may be processed by the audio processing system 250 to produce a signal with an improved signal-to-noise ratio. It should be noted that embodiments of the technology described herein may be practiced utilizing only the primary microphone 230.

The output device 260 is any device which provides an audio output to the user. For example, the output device 260 may include a speaker, an earpiece of a headset or handset, or a speaker on a conference device.

In various embodiments, where the primary and secondary microphones are omni-directional microphones that are closely-spaced (e.g., 1-2 cm apart), a beamforming technique may be used to simulate forwards-facing and backwards-facing directional microphones. The level difference may be used to discriminate speech and noise in the time-frequency domain which can be used in noise reduction.

Figure 3:
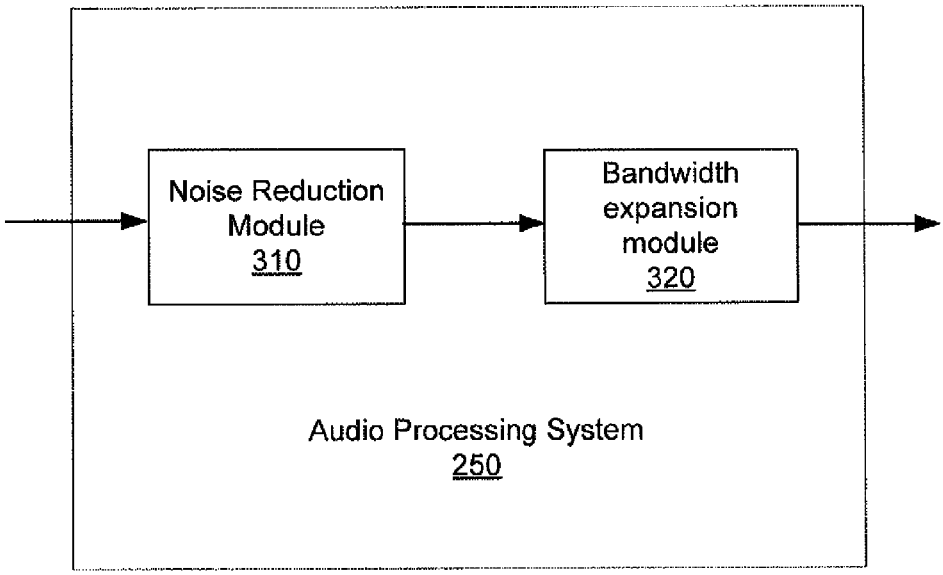
FIG. 3 is a block diagram of an exemplary audio processing system.

FIG. 3 is a block diagram of an exemplary audio processing system 250. In one embodiment, the audio processing system of FIG. 3 provides more detail for audio processing system 250 in the method of FIG. 2. Audio processing system 250 may receive a narrow band acoustic signal received from audio communication network 120.

Noise reduction module 310 may receive the narrow band signal and provide a noise reduced version to bandwidth expansion module 320. An audio processing system suitable for performing noise reduction by noise reduction module 310 is discussed in more detail in U.S. patent Ser. No. 12/832,901, titled "Method for Jointly Optimizing Noise Reduction and Voice Quality in a Mono or Multi-Microphone System," filed on Jul. 8, 2010, the disclosure of which is incorporated herein by reference.

Bandwidth expansion module 320 may process the noise reduced narrow band signal to expand the bandwidth of the signal. Bandwidth expansion module 320 is discussed in more detail below with respect to FIGS. 4-11.

Figure 4:
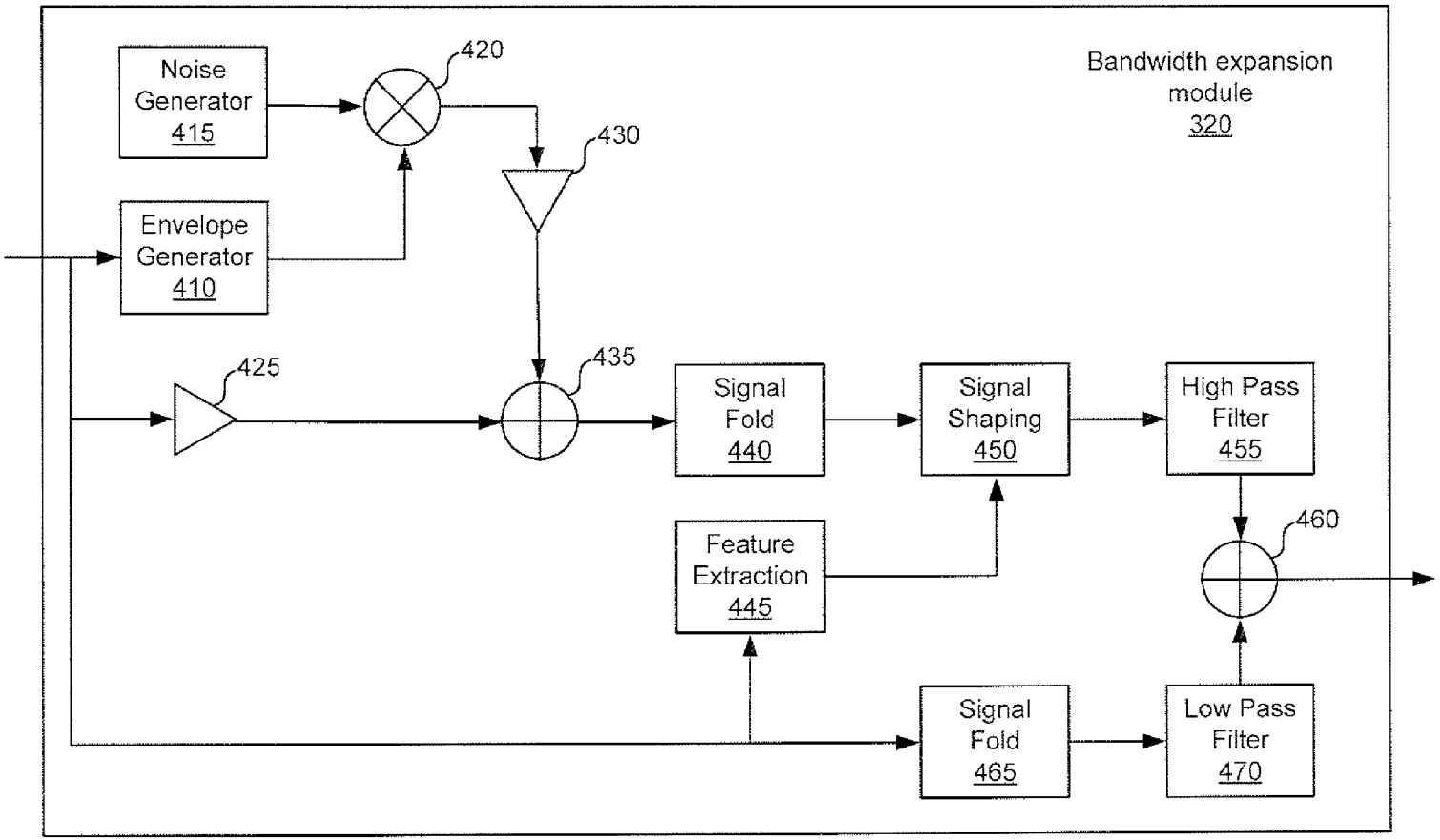
FIG. 4 is a block diagram of an exemplary bandwidth expansion module.

FIG. 4 is a block diagram of an exemplary bandwidth expansion module. The module of FIG. 4 may provide more detail for bandwidth expansion module 320 in FIG. 3. A narrow band signal is received by bandwidth expansion module 320. The narrow band signal is processed by envelope generator module 410. Envelope generator module 410 may construct an envelope component from peaks in the received signal. The envelope component created from the narrow band signal peaks is provided to modulator 420.

Noise generator module 415 may generate a noise signal. The noise signal may be described as a function N, which may be expressed as $$n(f) = \frac{1}{f^a},$$

Where 1<a<2. For example, if a=1, a "pink" noise signal may be generated while if a=2, a "Brownian" noise signal may be generated. The generated noise signal is provided to modulator 420.

Modulator 420 combines the generated noise signal and the narrow band envelope into a single modulated signal. Hence, the noise signal is modulated to provide greater energy at frequencies having higher energy within the narrow band signal. The modulated signal is then provided to gain module 430 where a gain is applied to the modulated signal, and the gain signal is then applied to combiner 435.

The narrow band received by bandwidth expansion module 320 may be provided to gain module 425. The output of gain module 425 is then applied to combiner 435, which combines the modulated noise signal and the narrow band signal output by gain module 425. The combined noise and narrow band signal is then provided to signal fold module 440.

Signal fold module 440 receives the combined signal and "folds" the signal. To fold the signal, the sampling of the signal is doubled by inserting samples having a magnitude of zero (0.0) in between each sample. The narrow band signal is up-sampled by two, resulting in a signal with twice the initial sampling rate and a spectrum symmetrical about the half band. The second half of the spectrum at high frequencies is a mirror image of the spectrum of the first half at lower frequency. By folding a signal, the signal frequencies appear as a mirror image about the upper frequency of the original combined signal.

Figure 5A:
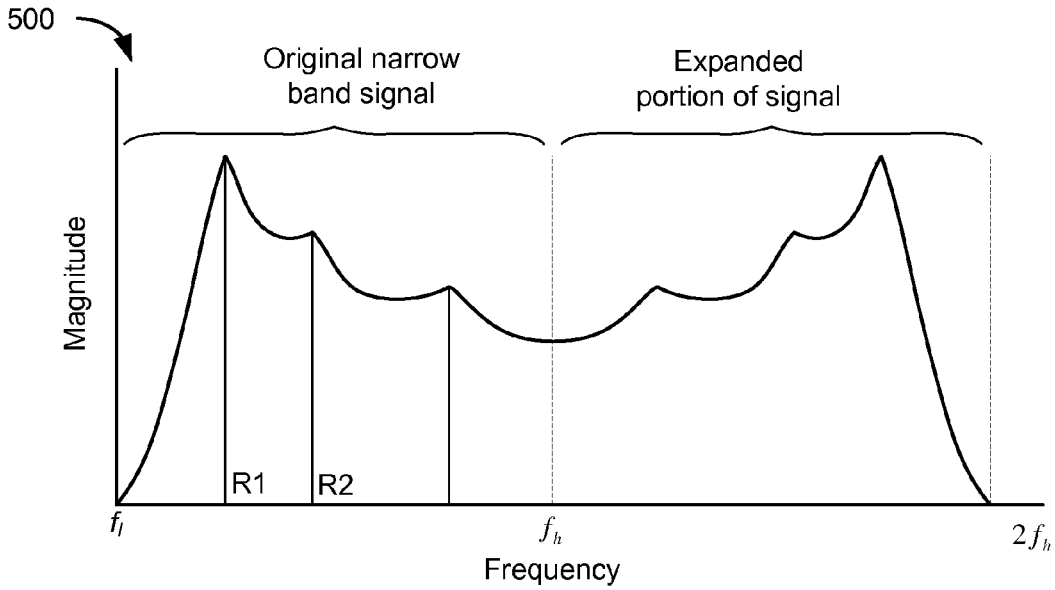
FIG. 5A is a plot of an expanded signal spectrum.

FIG. 5A illustrates a plot of an expanded signal spectrum 500. The exemplary plot in FIG. 5A illustrates the original narrow bandwidth signal having frequency values between a low frequency $f_l$ and a high frequency $f_h$. The original narrow bandwidth signal is processed by spectrum folding the signal to expand the frequency spectrum, such that the expanded portion of the signal appears as a mirror image of the narrow original band signal spectrum. In FIG. 5A, the expanded portion of the signal is from $f_h$ to 2 $f_h$.

Feature extraction module 445 receives the narrow bandwidth signal and extracts a feature from the signal. The feature may include pitch estimation, pitch energy, energy ratio, or some other feature. For example, the feature may include a ratio of energy in a first portion of the narrow bandwidth signal to the energy in a second portion of the narrow bandwidth signal. The ratio of the energy in the first portion of the spectrum to the energy of the second portion of the spectrum may be determined per frame of the far-end signal. The one or more features may be sent to signal shaping module 450.

Signal shaping module 450 receives the signal with the folded spectrum from signal fold module 440 and one or more features from feature extraction module 445. Signal shaping module 450 then applies a filter to the expanded signal based on one or more features.

Signal shaping module 450 may shape the expanded signal to help the expanded portion of the signal comply with characteristics and pattern of the narrow band signal. For example, if the narrow band signal is characteristic of speech, the signal shaping module 450 may shape the expanded portion of the signal to better resemble a spectrum resembling a speech model. In one embodiment, signal shaping module 450 may shape the expanded signal based on a feature of the narrow band signal. Signal shaping module 450 may select a filter, such as a shelf filter, based on a feature received from feature extraction module 445 and apply the selected filter to the expanded signal received from signal fold module 440.

Figure 5B:
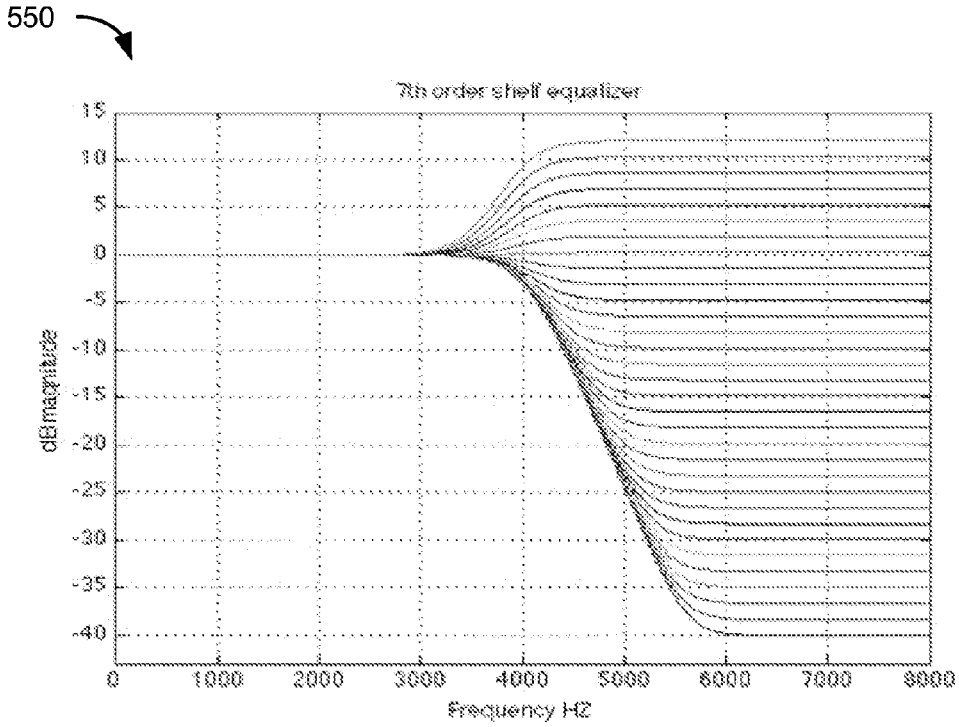
FIG. 5B is a plot of exemplary shelf filter transfer functions.

FIG. 5B is a plot of exemplary shelf filtered transfer functions 550. The plot in FIG. 5B illustrates frequency versus magnitude for a variety of transfer functions corresponding to shelf filter models which may be selected based on a narrow band signal feature. Transfer functions having amplitude greater than zero at a frequency greater than 3500 Hz correspond to signals having a significant noise component. Transfer functions having a magnitude of less than zero after 3500 Hz may be selected to shape a narrow band signals having voice content (a ratio value of greater than 1).

Once a shelf filter is applied to the folded signal, signal shaping module 450 provides the filtered signal to a high pass filter module 455. High pass filter module 455 applies a high pass filter to the filtered signal in order to retain only the expanded portion of the signal.

The narrow band signal received by bandwidth expansion module 320 may be expanded at signal fold module 465 and filtered by low pass filter 470. The high pass filtered signal and the low pass filtered signal are combined at combiner 460 and provided as output by bandwidth expansion module 320.

Figure 6:
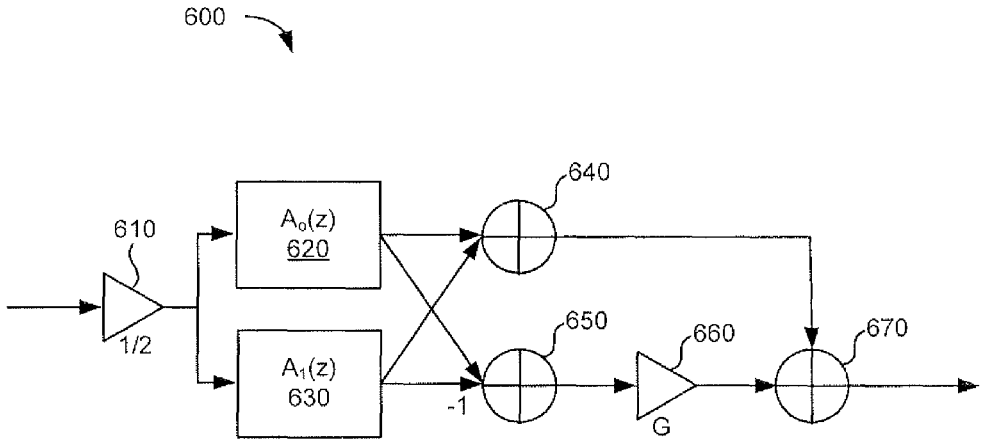
FIG. 6 is a block diagram of an exemplary shelf filter.

FIG. 6 is a block diagram of an exemplary shelf filter 600. FIG. 6 provide additional information for signal shaping module 450 in the system of FIG. 4. The filter of FIG. 6 is a shelf equalizer that that uses two all-pass subsystems 620 and 630, rather than one all-pass subsystem of a traditional Regalia filter system. Regalia techniques are only suitable for first order shelf equalizers, and are very difficult to implement.

The all-pass subsystems 620 and 630 are generated by factoring a low pass prototype filter 610, which may be designed using several methods including but not limited to odd order elliptic, Butterworth, Chebyschev filter design methods, into power complimentary all-pass subsystems. The all-pass subsystems $A_0(z)$ 620 and $A_1(z)$ 630 can then form high pass and low pass complimentary filters. The outputs of all-pass subsystems 620 and 630 are then summed at summing modules 640 and 650. The high pass branch associated with summing module 650 may be scaled by a gain G 660, which produces a shelving equalizer filter 670. The prototype filter can be of any order, such as an odd order, allowing an arbitrary slope in the transition region.

Figure 7:
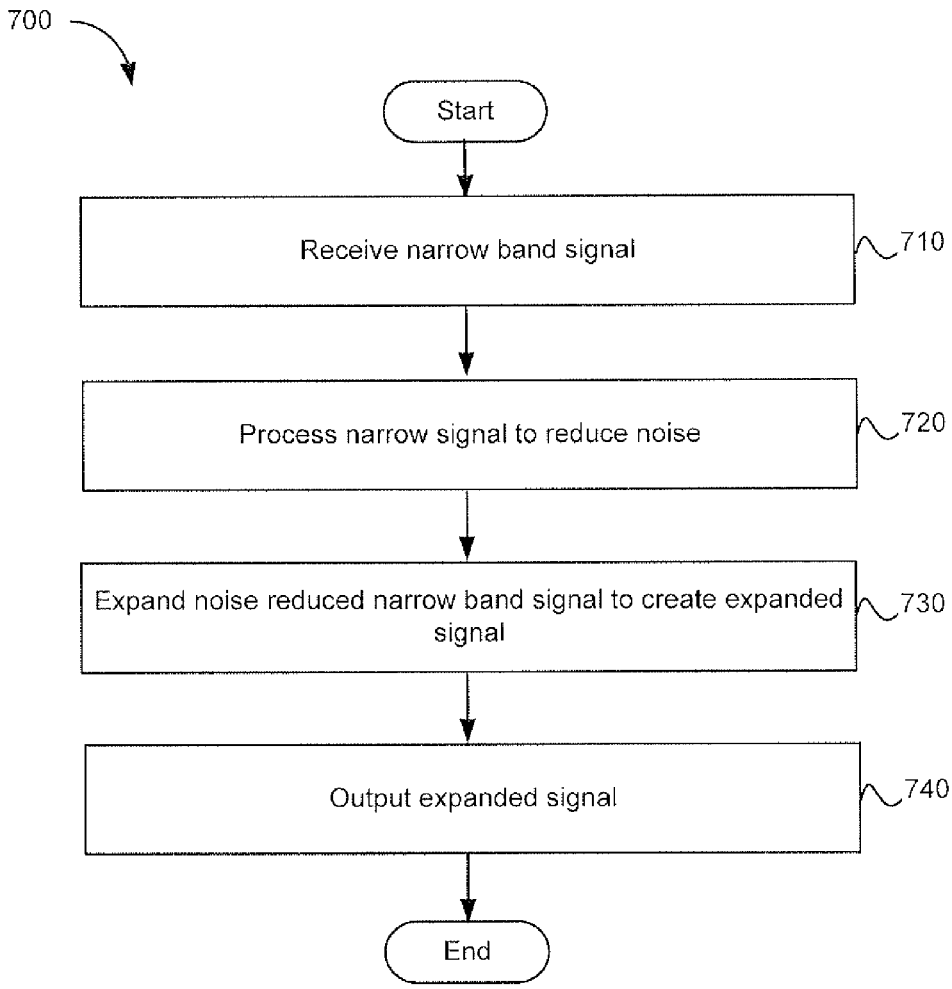
FIG. 7 illustrates an exemplary method for processing an audio signal.

FIG. 7 illustrates an exemplary method for processing an audio signal 700. The method of FIG. 7 may be performed by mobile device 110. First, a narrow band signal is received at step 710. The narrow band signal may be received by mobile device 110 from mobile device 140 via audio communication network 120. The narrow band signal may have a bandwidth limited by the audio network which transmitted the signal from mobile device 140 to mobile device 110.

The narrow band signal may be processed to reduce noise at step 720. Reducing noise may include steps such as detecting a noise component, echo component and noise component, reducing the noise by subtractive cancellation or multiplicative noise suppression, and other processing. Processing the expanded signal to reduce noise is described in more detail in U.S. patent Ser. No. 12/832,901, titled "Method for Jointly Optimizing Noise Reduction and Voice Quality in a Mono or Multi-Microphone System," filed on Jul. 8, 2010, the disclosure of which is incorporated herein by reference.

The noise reduced narrow band signal may be expanded to create an expanded signal at step 730. The narrow band signal may be expanded in a simple and efficient manner. The expansion may involve signal spectrum folding as well as signal shaping to form an expanded signal. Expanding a narrow band acoustic signal is discussed in more detail below with respect to FIG. 8.

After expanding the narrow band acoustic signal, the expanded signal is output at step 740. The signal may be output via a speaker or some other output device.

Figure 8:
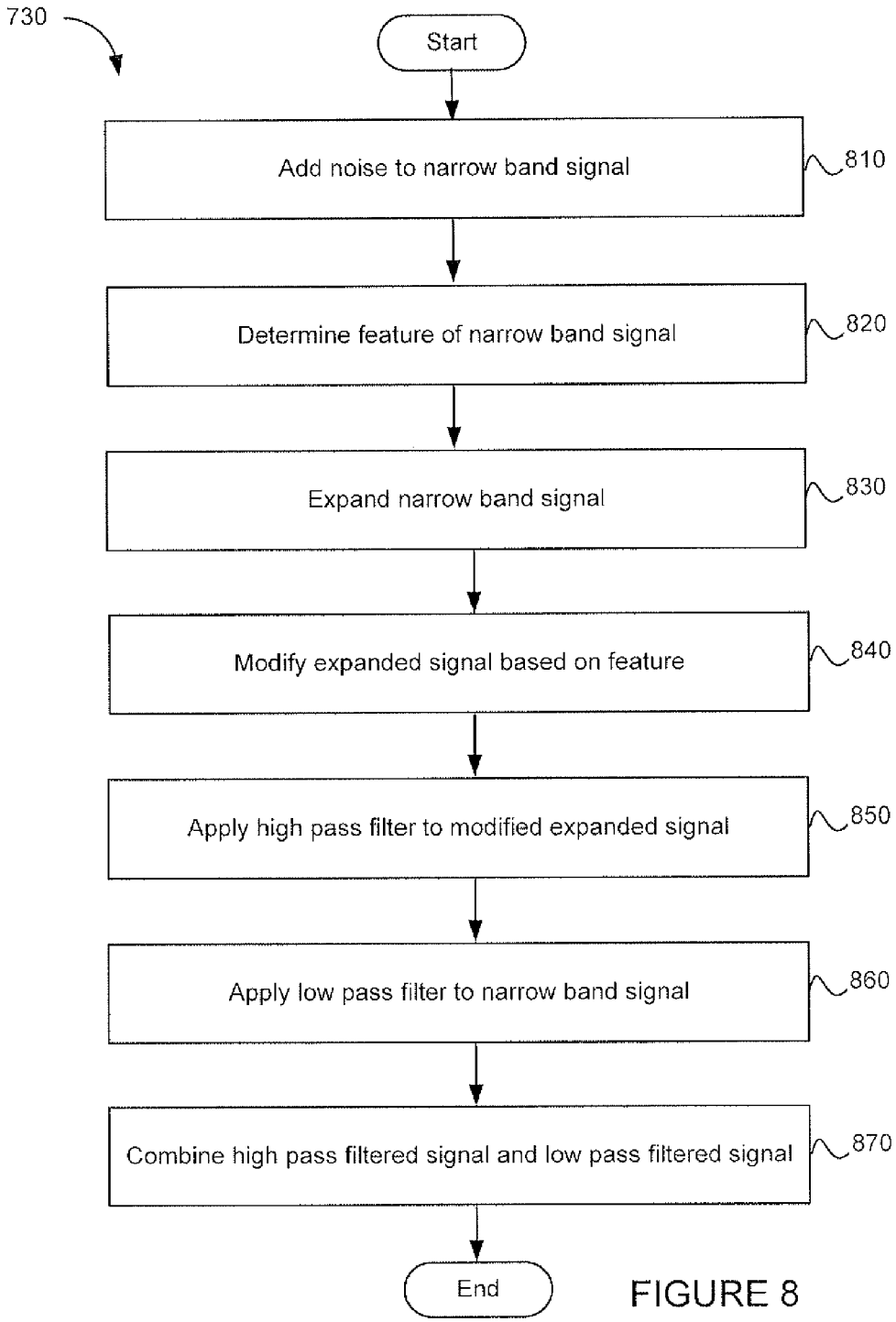
FIG. 8 illustrates an exemplary method for expanding an acoustic signal.

FIG. 8 illustrates an exemplary method for expanding an acoustic signal. In some environments, the method of FIG. 8 provides more detail for step 730 of the method of FIG. 7. First, noise may be added to the acoustic signal at step 810. The noise may be added to mask any non-harmonic sounds that result from expanding the signal. Adding noise can help mask the missing harmonic information which can be introduced by expanding a signal. The noise may be added using modulation techniques. Adding noise to an acoustic signal is discussed in more detail below with respect to FIG. 9.

A feature of an acoustic signal may be determined at step 820. The feature can be a measured property of a signal or derived from the signal. For example, the feature may be a ratio of energy in different portions of the narrow band acoustic signal. Determining a feature of an acoustic signal is discussed in more detail below with respect to FIG. 10. The acoustic signal may be expanded at step 830. The signal may be expanded to have a bandwidth greater than the of the narrow band signal bandwidth provided over an audio communication network. The expansion of the signal may involve folding the signal to create an extended frequency spectrum in a mirror image of the original frequency spectrum. An illustration of a folded signal spectrum is illustrated in FIG. 5A.

An expanded signal may be modified based on a feature at step 840. A feature may be used to select a filter model which may then be applied to the expanded signal spectrum, for example by signal shaping module 450. Modifying the expanded signal based on a feature is described in more detail below with respect to FIG. 11.

A high pass filter may be applied to a modified expanded signal at step 850. A high pass filter may be applied to select only the upper frequency portion, or the extended portion, of an expanded signal. A low pass filter may be applied to the original received narrow band signal at step 860. The low pass filter may be applied to ensure that only the original signal is used in generating an output signal. The high pass filtered signal and the low pass filtered signal may be combined at step 870. Combining the signals may be formed by a simple combiner, but may also involve smoothing of the signals to avoid any distortion.

Figure 9:
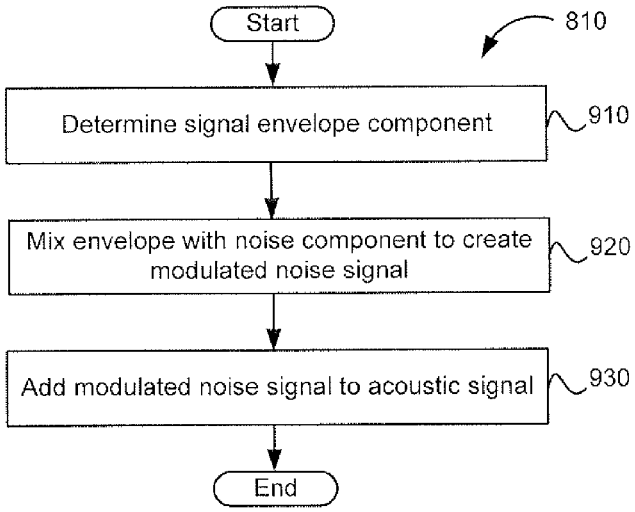
FIG. 9 illustrates an exemplary method for adding noise to an acoustic signal.

FIG. 9 illustrates an exemplary method for adding noise to an acoustic signal. The method of FIG. 9 provides more detail for step 810 in the method of FIG. 8. First, a signal envelope component is generated at step 910. The signal envelope may be derived from a magnitude of pulses or other information which comprise the received narrow band signal. The envelope may be modulated with a noise component to create a modulated noise signal at step 920. The noise component may be generated as pink noise, brown noise, or some other noise function. A modulated noise signal is then combined with the acoustic signal at step 930.

Figure 10:
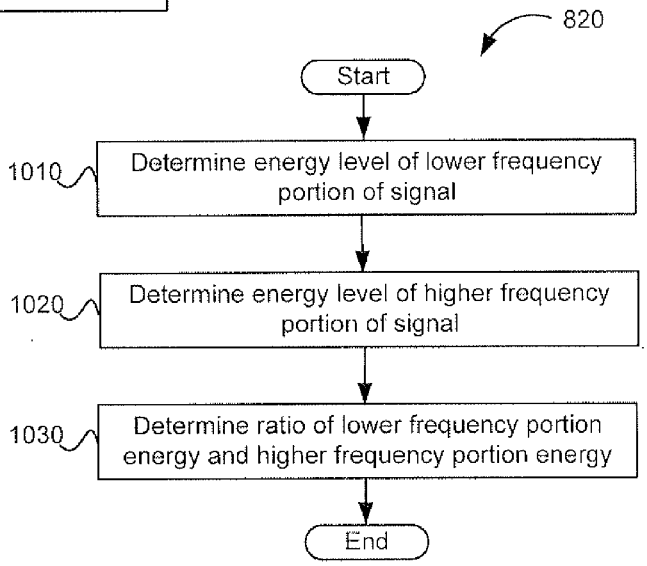
FIG. 10 illustrates an exemplary method for determining a feature of an acoustic signal.

FIG. 10 illustrates an exemplary method for determining a feature of an acoustic signal. The method of FIG. 10 may provide more detail for step 820 of the method of FIG. 8. First, an energy level of a lower frequency portion of a signal is determined at step 1010. The energy level may be determined as amplitude of a peak, a total energy under a first portion of a signal M envelope, or some other energy. With respect to FIG. 5A, the energy may be the energy of frequency components less than R1, the energy of frequency component R1, or some other low frequency energies.

An energy level of a higher frequency portion of the narrow band signal may be determined at step 1020. The energy level of the higher frequency portion may be determined in the same way as the energy level of the lower frequency portion, but is performed for a different portion of the narrow band signal. For example, the energy may be the frequency components greater than R2, the energy of frequency component R2, or some other frequency energies.

A ratio of the lower frequency portion energy and the higher frequency portion energy is determined at step 1030. The ratio is determined to identify whether a narrow band signal can be characterized as speech, noise, or some other type of signal. For example, in a voice signal, the lower frequency portions will have more energy than the higher frequency portions. Thus, in voice signals, the ratio of the lower frequency components to the higher frequency components will be greater than 1.

Figure 11:
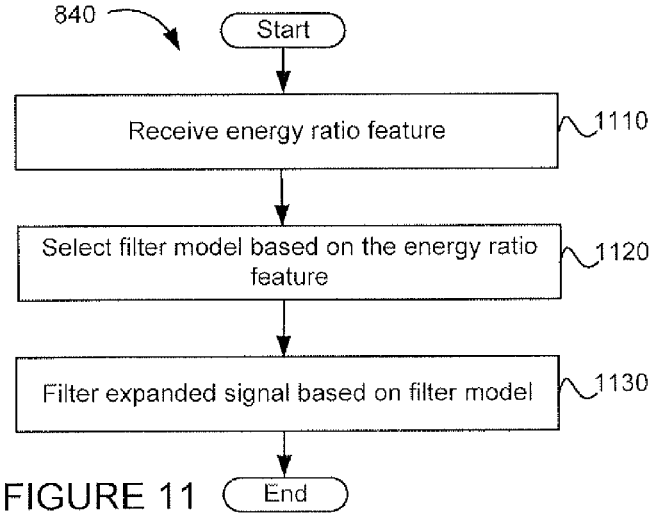
FIG. 11 illustrates an exemplary method for modifying an expanded signal based on a feature.

FIG. 11 illustrates an exemplary method for modifying an expanded signal based on a feature. The method of FIG. 11 provides more detail for step 840 in the method of FIG. 8. First, an energy ratio feature is received at step 1110. The ratio feature may be received by signal shaping module 450 from feature extraction module 445. A filter model may be selected based on the received energy ratio feature at step 1120. The selected filter model may have one of the transfer functions illustrated in the plot of FIG. 5B. After the filter model is selected, the expanded signal may be filtered based on the filter model at step 1130. The filter may be performed at signal shaping module 450.

The above described modules, including those discussed with respect to FIGS. 3 and 4, may be included as instructions that are stored in a storage media such as a machine readable medium (e.g., computer readable medium). These instructions may be retrieved and executed by the processor 220 to perform the functionality discussed herein. Some examples of instructions include software, program code, and firmware. Some examples of storage media include memory devices and integrated circuits.

While the present invention is disclosed by reference to the preferred embodiments and examples detailed above, it is to be understood that these examples are intended in an illustrative rather than a limiting sense. It is contemplated that modifications and combinations will readily occur to those skilled in the art, which modifications and combinations will be within the spirit of the invention and the scope of the following claims.

What is claimed is:

1. A method for processing an audio signal, comprising:

determining a feature of a received signal, the feature including a ratio of a first energy associated with a lower frequency of the received signal and a second energy associated with a higher frequency of the received signal;

executing a bandwidth expansion module stored in memory to expand the spectrum of the received signal to create an expanded signal; and modifying the expanded signal based on the feature of the received signal, the modifying including selecting a filter model to apply to the expanded signal based on the feature.

2. The method of claim 1, further comprising adding a noise component to the received signal.

3. The method of claim 2, wherein the noise component is modulated based on a speech characteristic of the received signal.

4. The method of claim 1, wherein expanding the spectrum includes performing spectrum folding on the received signal.

5. The method of claim 1, wherein the filter model is a shelf filter module.

6. The method of claim 5, wherein the shelf filter module is constructed from two all pass filters.

7. The method of claim 1, further comprising performing noise reduction on the modified expanded signal.

8. A non-transitory computer readable storage medium having embodied thereon a program, the program being executable by a processor to perform a method for processing an audio signal, the method comprising:

determining a feature of a received signal, the feature including a ratio of a first energy associated with a lower frequency of the received signal and a second energy associated with a higher frequency of the received signal;

expanding the spectrum of the received signal to create an expanded signal; and modifying the expanded signal based on the feature of the received signal, the modifying including selecting a filter model to apply to the expanded signal based on the feature.

9. The non-transitory computer readable storage medium of claim 8, further comprising adding a noise component to the received signal.

10. The non-transitory computer readable storage medium of claim 9, wherein the noise component is modulated based on a speech characteristic of the received signal.

11. The non-transitory computer readable storage medium of claim 8, wherein expanding the spectrum includes performing spectrum folding on the received signal.

12. The non-transitory computer readable storage medium of claim 8, wherein the filter model is a shelf filter module.

13. The non-transitory computer readable storage medium of claim 12, wherein the shelf filter module is constructed from two all pass filters.

14. The non-transitory computer readable storage medium of claim 8, further comprising performing noise reduction on the modified expanded signal.

15. A system for processing an audio signal, comprising:

a processor;

a signal fold module stored in memory and executed by the processor, the signal fold module receiving an audio signal and providing an expanded signal having an expanded spectrum;

a feature extraction module stored in memory and executed by the processor, the feature extraction module receiving the audio signal and providing a feature based on the audio signal, the feature including a ratio of a first energy associated with a lower frequency of the received signal and a second energy associated with a higher frequency of the received signal; and a signal shaping module stored in memory and executed by the processor, the signal shaping module modifying an expanded signal based on the feature, the modifying including selecting a filter model to apply to the expanded signal based on the feature.

16. The system of claim 15, further comprising:

a noise generation module stored in memory and executed by the processor, the audio signal including a noise component generated by the noise generation module.

17. The system of claim 15, further comprising a noise reduction module stored in memory and executed by the processor, the noise reduction module performing noise reduction on the modified expanded signal.

* * * * *